United States Patent [19]

Haber

[11] Patent Number: 4,893,443

[45] Date of Patent: Jan. 16, 1990

[54] SEALED DOUBLE GLAZING UNIT

[75] Inventor: Ronald Haber, Chestnut Ridge, N.Y.

[73] Assignee: W & W Glass Products Ltd., Spring Valley, N.Y.

[21] Appl. No.: 298,635

[22] Filed: Jan. 18, 1989

[51] Int. Cl.[4] ..... E06B 3/00

[52] U.S. Cl. ..... 52/208; 52/398; 52/788; 52/304; 52/790

[58] Field of Search ..... 52/235, 304, 397, 398, 52/785, 788, 789, 790, 803, 807, 817, 825, 826, 402, 403, 208

[56] References Cited

U.S. PATENT DOCUMENTS

| | | | |
|---|---|---|---|
| 2,936,050 | 5/1960 | McLaughlin | 52/788 X |
| 3,968,608 | 7/1976 | Swango . | |
| 4,004,388 | 1/1977 | Stefanik | 52/398 |
| 4,204,374 | 5/1980 | Olson | 52/208 |
| 4,324,373 | 4/1982 | Zibritosky | 52/208 X |
| 4,418,506 | 12/1983 | Weber et al. . | |
| 4,500,572 | 2/1985 | Francis . | |
| 4,552,790 | 11/1985 | Francis . | |
| 4,581,868 | 4/1986 | McCann | 52/398 |
| 4,680,206 | 7/1987 | Yoxon et al. . | |
| 4,689,929 | 9/1987 | Wright . | |

FOREIGN PATENT DOCUMENTS

| | | | |
|---|---|---|---|
| 1207957 | 10/1970 | United Kingdom | 52/785 |

*Primary Examiner*—David A. Scherbel
*Assistant Examiner*—Creighton Smith
*Attorney, Agent, or Firm*—Amster, Rothstein & Ebenstein

[57] ABSTRACT

A sealed double glazing unit includes a mounting system, disposed in at least one corner of the inner and outer panes, for mounting of the unit to a supporting member. The mounting system includes a torus extending between the panes coaxially with the pane apertures in the corner and having the end surfaces thereof secured to facing surfaces of the panes about the pane apertures, a sleeve extending through the hole of the torus and having its end portions disposed at least partially within respective ones of the pane apertures, and sealant securing the outer surface of the sleeve to the inner surface of the torus and preferably the pane apertures as well. A method of making the unit is also disclosed.

23 Claims, 5 Drawing Sheets

SEALED DOUBLE GLAZING UNIT

BACKGROUND OF THE INVENTION

The present invention relates to sealed double glazing units and, more particularly, to such a unit comprising an outer pane and an inner pane which are spaced apart by a perimeter seal.

It is known to construct glass wall assemblies in which adjacent glass sheets are secured together and are secured to structural members of a building by means of metal plates to which the sheets are bolted.

It is desirable, for their insulative properties, to construct glass wall assemblies from double glazing units. But when seeking to provide the desired outward appearance of such units, in which the outer glass sheets appear to the observer to be mounted edge-to-edge to form an uninterrupted glass wall, problems arise in mounting the units without a frame enclosing the edges of each double glazing unit. Such units can be mounted either using adhesives or mechanical fixings for fixing the units to structural supporting members of a building. Mechanical fixing is preferred for greater mechanical security, but there are difficulties in securing a double glazing unit mechanically without enclosing the edges, while ensuring that the seal of the double glazing unit is maintained to prevent ingress of moisture and air into the evacuated space between the panes of the unit.

In U.S. Pat. No. 4,581,868 there is described a construction in which sealed double glazing units are secured to supporting members, with the outer sheets of the units sealed edge-to-edge by a sealing compound, and each of the units secured to the supporting members by mechanical fixings which pass through flanges of the outer sheets outside the seals of the unit.

U.S. Pat. No. 4,680,206 provides another solution to the problem of the mechanical fixing of a sealed double glazing unit to supporting members. According to this patent, a mechanical fixing means passes through the sealed air space of the double glazing unit, with a moisture-tight seal being provided between the panes and the mechanical fixing, in such a manner as to permit the double glazing unit to flex under the variable loads which are encountered in service, such as wind load. According to the patent, the sealed double glazing unit comprises an outer pane and an inner pane which are spaced apart by a perimeter seal, and has at least one fixing position within the perimeter seal for fixing the unit without obstructing its outer edge. At the fixing position there is a fixing assembly which is attached to one of the panes in a manner which permits the unit to flex under wind load without impairing the seal of the unit. The fixing assembly, among other things, acts as a sleeve to protect the panes from contact with the fixing member or bolt which is used to secure the unit to the fixing member. As illustrated in FIG. 4 thereof, a spacer in the form of a torus has the opposing end faces thereof secured by an inner silicone seal and an outer butyl seal to the opposing faces of the panes, thus presumably preventing a loss of integrity in the area of the fixing assembly from impairing the integrity of the remainder of the unit.

Even when such a spacer is provided about the fixing assembly, the fixing assembly requires within and between the panes numerous elements including a resilient bush, a fiber washer, a clamping disc, a metal washer, a clamping nut, and a distance-maintaining piece. The cost of such materials, and the labor required to apply them, add substantially to the cost of the unit. Apart from these economic factors, the mechanical clamping of the fixing assembly about one or both panes can lead to breakage of the pane being clamped or the introduction of internal stresses within the pane rendering the same more subject to breakage in use. Furthermore, the presumably air-tight connection between the spacer and the panes is effected by a thin layer of sealant which may not provide adequate protection against leakage from the fixing assembly within the spacer into the remainder of the unit outside the spacer.

Accordingly, it is an object of the present invention to provide an improved sealed double glazing unit which does not have a fixing assembly mechanically attached to either pane.

Another object is to provide such a unit afforded improved air-tight isolation of the fixing assembly from the remainder of the unit.

A further object is to provide such a unit in which the fixing assembly is secured in place without being mechanically attached to either pane.

It is also an object of the present invention to provide such a unit having a simplified and more economical construction.

It is a further object to provide a simple, fast and economical method of making such a unit.

SUMMARY OF THE INVENTION

It has now been found that the above and related objects of the present invention are obtained in a sealed double glazing unit comprising an outer pane and an inner pane, each defining in at least one corner thereof an aperture therethrough. The pane apertures are axially aligned and a peripheral sealing means is disposed about the periphery of the panes. Mounting means, disposed in the at least one corner of the panes, enables mounting of the unit to a supporting member. The mounting means includes a torus, a sleeve and sealant. The torus extends between the panes coaxially with the pane apertures and has the end surfaces thereof secured to facing surfaces of the panes about the pane apertures. The sleeve extends through the hole of the torus and has its end portions disposed at least partially within respective ones of the pane apertures. The sealant secures the outer surface of the sleeve to the inner surface of the torus.

In a preferred embodiment, sealant is disposed intermediate the sleeve outer surface and the facing surfaces of the torus and the pane apertures so that substantially the entire outer surface of the sleeve is secured to the torus and the panes by the sealant. The torus has generally planar end surfaces which converge slightly adjacent the hole thereof, thereby to provide space for the sealant intermediate the torus and the panes. The sleeve, which is preferably nylon, has an outer diameter appreciably less than the inside diameter of one of the pane apertures. The sealant is slightly flexible and forms an air-tight connection between the sleeve outer surface and the torus and panes. It will be appreciated that neither of the panes is mechanically clamped to either the sleeve or the torus.

The mounting means may additionally include an outer patch fitting-, an inner patch fitting, and securing means extending through the sleeve and connecting the inner and outer fittings for locking the outer fitting, the panes, the torus, the sleeve and the inner fitting together as a unit. The fittings enable joinder of the unit with another vertically-aligned unit and another horizontally-aligned unit. Preferably, the sleeve is configured and dimensioned to receive, and isolate from the panes, a threaded bolt passing through the fittings as part of the securing means. The supporting member is an adjacent one of the units, and the mounting means mounts the unit to the adjacent units either directly or via an intermediate member comprising a structural element or mullion. More particularly, the inner fitting may extend vertically to enable direct joinder with a vertically-aligned one of the units and rearwardly to enable indirect joinder with a horizontally-aligned one of the units through an intermediate member comprising a mullion or structural element.

In one preferred embodiment, the securing means comprise a bolt of integral one-piece construction with the outer fitting, and the outer fitting is disposed totally outside of the pane aperture of the outer pane. In another preferred embodiment, the outer fitting and sleeve are of integral one-piece construction, the outer fitting being disposed totally within the pane aperture of the outer pane, and the securing means including a bolt having a head disposed totally within the outer fitting.

The present invention further encompasses a method of making a sealed double glazing unit comprising the step of providing an outer pane and an inner pane, each defining in at least one corner thereof an aperture therethrough. The panes are then superposed in spaced apart relationship with the pane apertures axially aligned, and a torus is positioned and secured between the panes coaxially with each pane aperture to form an air-tight connection between the torus end surfaces and the facing pane surfaces. The volume of the hole is substantially filled with sealant. A sleeve having a removable dowel fully occupying the interior of the sleeve is provided for each corner, and the dowel-containing sleeve is inserted through one pane aperture, through the hole of the torus, and into the other pane aperture before the sealant is cured. The dowel is removed from the sleeve to leave sealant disposed intermediate the sleeve outer surface and the torus inner surface, thereby securing together the sleeve and the torus, while leaving the sleeve interior open for passage of a bolt therethrough. Finally the sealant is cured.

In a preferred embodiment, the volumes of both pane apertures are filled with sealant, thereby securing by sealant the sleeve outer surface to both the torus and the pane apertures. Prior to filling the hole of the torus with sealant, the exterior surface of the other pane aperture is blocked to prevent escape of sealant therethrough. After excess sealant is driven out of the unit through the one pane aperture by inserting the dowel-containing sleeve, the exterior surface of the other pane aperture is unblocked.

In another preferred embodiment, the volume of at least one of the pane apertures is filled with sealant, thereby securing by sealant the sleeve outer surface to both the torus and at least one of the pane apertures. Prior to filling of the hole of the torus with sealant, the exteriors surface of the other pane aperture is blocked to prevent the escape of sealant therethrough. After the sealant is injected and partially cured, the exterior surface of the other pane aperture is unblocked to enable the escape of sealant therethrough. Subsequently, excess sealant is driven out of the unit through the one pane aperture by inserting the dowel-containing sleeve.

BRIEF DESCRIPTION OF THE DRAWING

The above brief description, as well as further objects and features of the present invention, will be more fully understood by reference to the following detailed description of the presently referred, albeit illustrative, embodiments of the present invention when taken in conjunction with the accompanying drawing wherein.

DETAILED DESCRIPTION OF THE PREFERRED EMBODIMENTS

Figure 2:
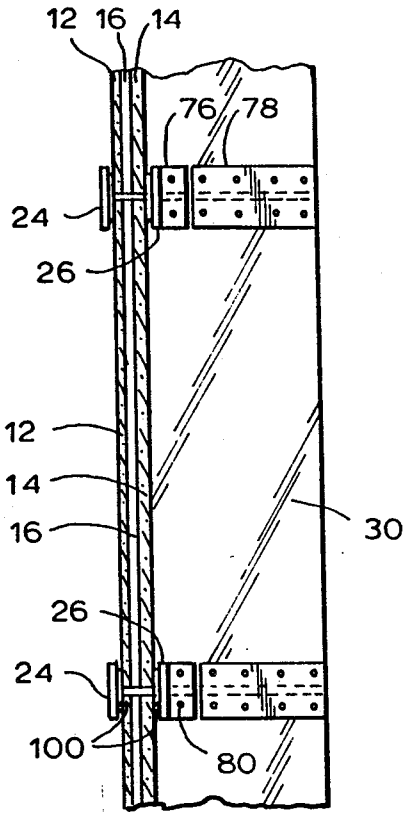
FIG. 2 is a fragmentary view taken along the line 2—2 of FIG. 1, and looking in the direction of the arrows, partially in cross-section.
Figure 1:
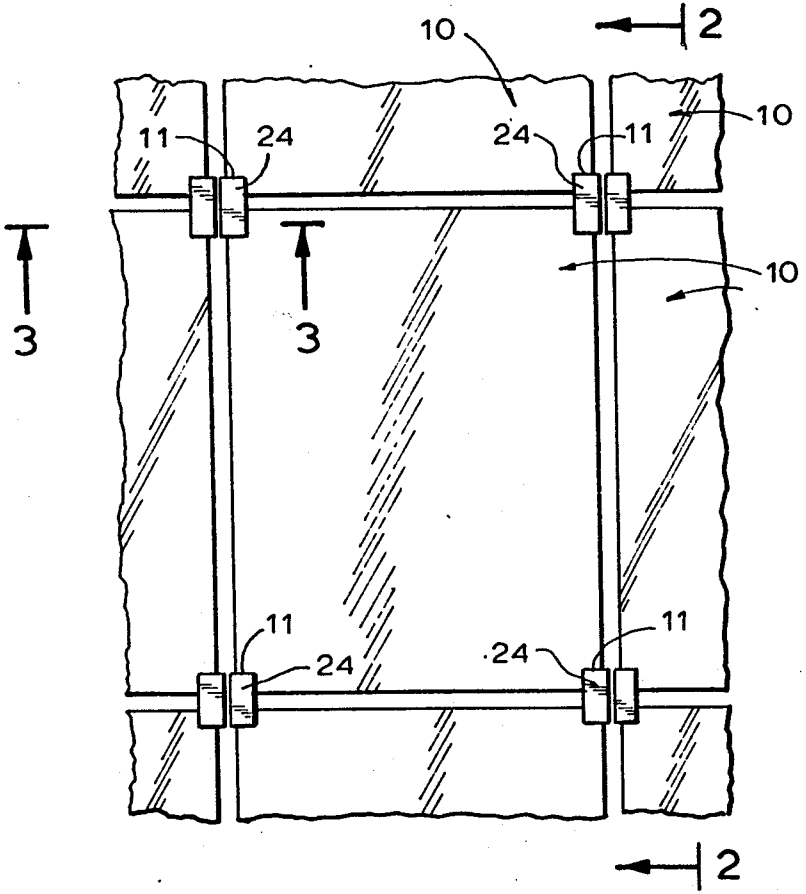
FIG. 1 is a fragmentary elevation view of the outside of a glass wall assembly constructed using sealed double glazing units-according to the present invention.

Referring now to the drawing, and in particular to FIGS. 1 and 2 thereof, therein illustrated is a glass wall assembly constructed using the sealed double glazing units according to the present invention, generally designated by reference numeral 10. Each unit 10 is approximately 2 meters by 4 meters and has four fixing positions 11 within its perimeter seal for fixing the unit 10 in position without obstructing its outer edge. The units 10 are fixed edge-to-edge, and the small gap between adjacent edges of the units is sealed with a silicone sealant (not shown). The glass wall assembly forms a planar array of the units 10, with each unit being comprised of an outer pane 12 and an inner pane 14. The panes 12, 14 are spaced apart by a perimeter seal, comprising a spacing frame 16 which is spaced inwardly from the edges of the panes 12, 14, primary sealant 17 intermediate panels 12, 14 and the spacing frame 16, and secondary sealant 18 (see FIG. 3) disposed laterally outwardly of the spacing frame 16 between the panels 12, 14. The pacing frame, though shown as solid for illustrative purposes, is actually hollow and filled with desiccant.

The outer pane 12 is a sheet of tempered glass 12 mm thick, and the inner pane 14 is a tempered pane 10 mm thick. When tempered glass is used, the glass sheets are drilled to form pane apertures 20 prior to tempering. Clearly the thicknesses of the panes and the dimensions of the unit may be varied to meet the requirements of particular applications.

Figure 3:
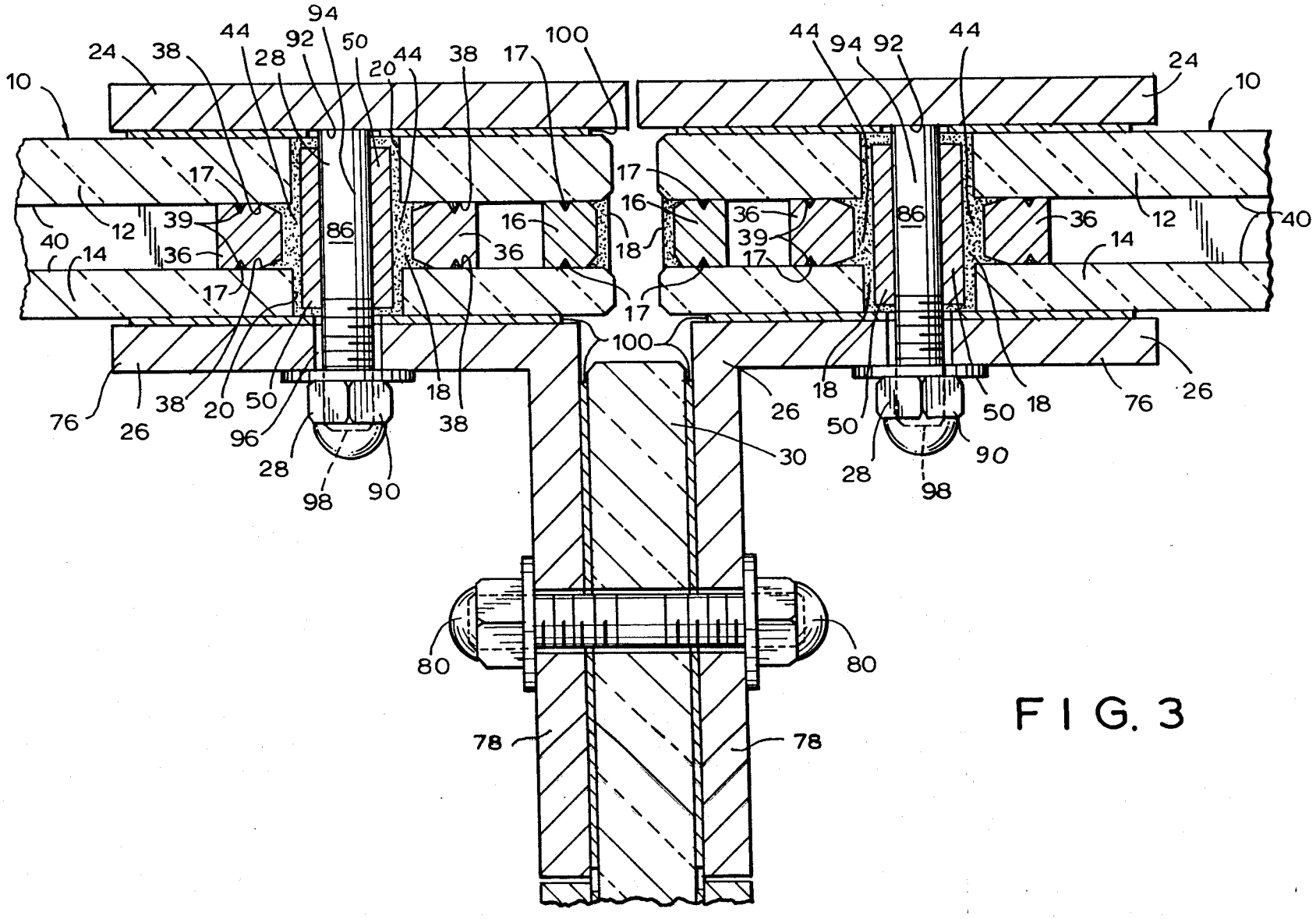
FIG. 3 is a fragmentary view taken along the line 3—3 of FIG. 1, and looking in the direction of the arrows, partially in cross-section and to a greatly enlarged scale.
Figure 4:
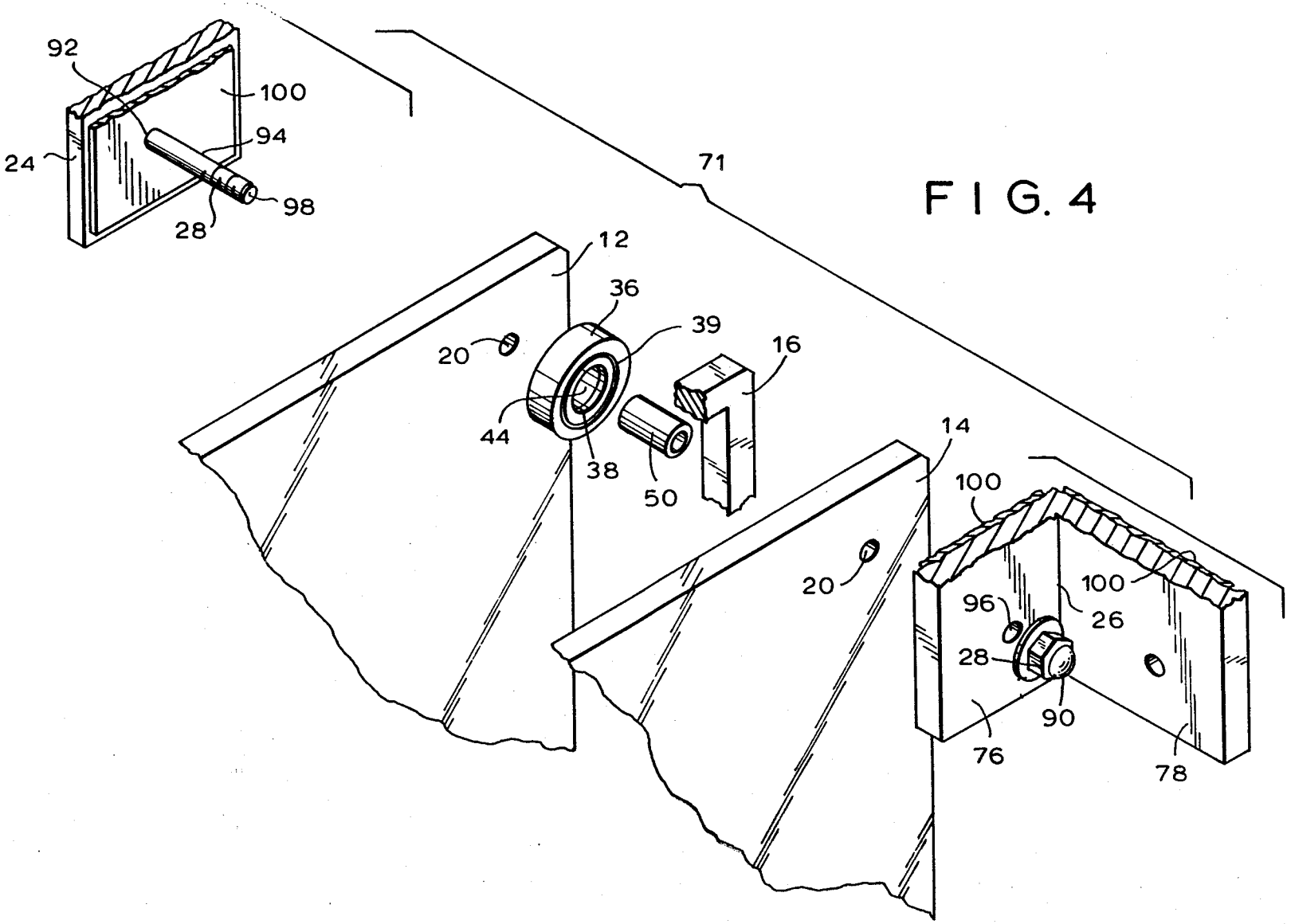
FIG. 4 is a fragmentary exploded isometric view of the non-sealant structural elements of one corner of a unit forming a part of a glass wall assembly.

Referring now to FIGS. 3 and 4 as well, each unit 10 is integrated into the glass wall assembly at each fixing position by means of an outer patch fitting 24 adjacent outer pane 12, an inner patch fitting 26 adjacent inner pane 14, and fixing or securing means 28, such as a bolt passing through the pane apertures 20 of the unit and a nut threaded on the bolt. The outer fitting 24 in the illustrated embodiment secures the unit 10 to a vertically-aligned adjacent unit, the outer fitting 24 in a lower corner of the unit 10 being shared with a vertically-aligned upper corner of the unit immediately below, just as the outer fitting 24 in an upper corner of the unit 10 is shared with the vertically-aligned lower corner of the unit immediately above. Alternatively, the outer fittings may be shared between immediately adjacent horizontally aligned units (rather than immediately adjacent vertically-aligned units) or a single outer fitting may extend over four adjacent corners of four adjacent units (two of the units being vertically-aligned and two of the units being horizontally-aligned) so that all four corners share a single outer fitting. The inner fittings 26 are secured in conventional manner to a supporting member 30 which is a mullion or structural element of a building and provides support against the positive or negative wind pressures exerted on the glass wall assembly. Typically the glass wall assembly is self-supporting with respect to the vertical forces on the units, but requires additional support with regard to the horizontal forces developed as a result of positive or negative wind pressure. AlternativelY, or in addition thereto, the inner fittings may be shared between immediately adjacent horizontally-aligned and/or vertically-aligned corners of adjacent units, in the same manner as the outer fittings.

Referring now to FIGS. 3 and 4 in particular, an annular spacer or torus 36 is disposed between the panes 12, 14, with the end faces 38 of the torus being sealed to the adjacent opposing faces 40 of the panes 12, 14 by a primary sealant 17. The inner diameter of the torus 36 is greater than the outer diameter of the pane apertures 20. A hollow space 44 is thus provided within the torus 36 for disposition of the fixing assembly without detriment to the hermetic air-tight seal of the remainder of the unit 10. Each end face 38 of the torus 36 (and each end face of the spacing frame 16 as well) defines a circumferential recess 39 to ensure that the primary sealant 17 is not squeezed out from between the opposing faces 38, 40 of the torus 36 and the panes 12, 14. The torus end faces 38 converge slightly as they approach the hole or axis of the torus for reasons which will become apparent hereinafter.

The torus 36 is preferably formed of a plastic such as nylon. The primary sealant 17 is preferably polyisobutylene (such as that available under the tradename Tremco from Tremco, Inc.), and the secondary sealant 18 is preferably a two part silicone (such as that available under the tradename IGS-3211 from General Electric Co.), although other conventional hermetic sealants may also be employed for these purposes. The secondary sealant combines structural strength with slight flexibility (like a caulking compound), whereas typically the primary sealant is a soft, highly flexible material without significant structural strength.

Coaxially disposed within the hollow space 44 defined by the torus 36 is a sleeve 50 extending between and at least partially through the pane apertures 20. While the sleeve 50 may extend fully through each of the pane apertures 20, the purpose of the sleeve 50 is to protect the glass of the panes 12, 14 from contact with the metal fixing member 28 and, accordingly, in particular applications it will be sufficient for the sleeve ends to extend only part way through the pane apertures 20. The outer diameter of the cylindrical sleeve 50 is necessarily less than the inner diameter of the pane apertures 20 with sufficient space provided between the sleeve outer diameter and the pane inner diameter so that a secondary sealant 18 may be interposed, thereby binding one end of sleeve 50 to the inner pane 14 and the other end of the sleeve 50 to the outer pane 12. Additionally, the gap or spacing between the outer diameter of one sleeve end and the inner diameter of the corresponding pane aperture 20 must be appreciable—that is, sufficient to permit the escape of uncured secondary sealant 18 from the hollow 44 therebetween and out of the unit 10, for reasons which become apparent hereinafter relating to the method of manufacturing the unit 10.

By way of example, and not as a limitation, for a unit 10 with a thickness of 3.49 cm (1.375 inches formed of a 0.5 inch outer pane 12, a 0.5 inch air space between panes, and a 0.375 inch inner pane 14), a preferred outer diameter of the torus 36 is 5.08 cm (2 inches), a preferred torus inner diameter, 2.54 cm (1 inch); a preferred outer diameter of the sleeve 50 is 1.11 cm (0.44 inch), and a preferred sleeve inner diameter, 1.91 cm (0.75 inch). A preferred end-to-end thickness of the torus 36 is 1.27 cm (0.50 inch), and a preferred end-to-end thickness of the sleeve 50 is 3.18 cm (1.25 inch). The sleeve 50, like the torus 36, is formed of nylon or similar plastics, although other materials may be used for both or either.

The volume of the hollow space 44 intermediate the inner diameter of the torus 36 and the outer diameter of the sleeve 50 is filled with a secondary sealant 18. The secondary sealant 18 further extends into the small gap between the torus inner surface and the adjacent pane surface and the small gap between the sleeve outer diameter and the facing surface of the panes 12, 14 (i.e., the surface defining the pane aperture 20), to insure an effective hermetic seal therebetween. The unit 10 is now ready for shipment to the final site where it will be assembled with other units to form the glass wall assembly.

The secondary sealant 18 thus bonds the sleeve 50 directly to the panes 12, 14 and torus 36, to securely hold the sleeve 50 in place, as part of the unit 10, during handling of the unit 10 prior to the deployment thereof as part of a glass wall assembly. The secondary sealant 18 is slightly flexible so that it secures the inner and outer panes 12, 14 to the sleeve 50 and torus 36 in a manner accommodating flexure of the panes 12, 14 together and independently in response to pressures exerted on the unit, such as wind loads, handling, and the like. The mass of secondary sealant 18 intermediate the torus 36 and sleeve 50 insures the effectiveness of the hermetic seal to isolate the portion of the unit outside of the torus 36 from the portion within the torus 36.

The torus 36 and sleeve 50 constitute, with the sealants 17, 18 and panes 12, 14, a fixing assembly which is later combined with mounting means (comprised of the inner and outer patch fittings 24, 26 and securing means 28) to form a complete assembly.

At the assembly site, the unit 10 is assembled with similar units 10 by means of mounting means generally designated 71 (see FIG. 4) and including an outer patch fitting 24, an inner patch fitting 26 and securing means 28 extending through the sleeve 50 and connecting the inner and outer fittings 26, 24 so as to lock together (with the sealants) as a single assembly the outer fitting 24, the outer pane 12, the torus 36, the sleeve 50, the inner pane 14 and the inner fitting 26.

In the illustrated embodiment the outer fitting 24 is a substantially rigid planar rectangular element. The width of the outer fitting 24 is typically centered about the pane aperture, as illustrated, with the overall width being sufficient to have one edge thereof extend laterally to and slightly beyond the edge of the unit 10, while leaving a small gap (typically filled with weather sealant) between itself and the immediately adjacent horizontally-aligned outer fitting 24 of another unit 10 to accommodate thermal expansion and the like. However, the only requirement is that the outer fitting 24 be wider than the outer pane aperture 20. The outer fitting 24 is of sufficient height or length to cover both the pane aperture 20 and the immediately adjacent vertically-aligned pane aperture 20 of another unit 10, as illustrated. Alternatively, if it is desired to support the vertically-aligned units 10 forming a glass wall assembly by means other than the outer fittings 24, each outer fitting 24 need be only of sufficient height or length to cover the outer pane aperture 20.

The inner patch fitting 26 is an angle member having a first leg 76 parallel to the inner pane 14 and a second leg 78 generally transverse thereto. The inner fitting 26 is, like the outer fitting 24, substantially rigid and of comparable thickness, about 0.87 cm (0.25 inch). While the first leg 76 is illustrated as extending medially toward the center line of the unit as far as the outer fitting 24, it is only necessary that the first leg 76 cover the inner pane aperture 20. The first leg 76 need not extend laterally as far as the edge of the unit 10, but may extend only sufficiently far in that direction to properly position the second leg 78 so that the second leg 78 may be secured in conventional fashion to a supporting member 30, which may be a mullion or a structural element of an adjacent structure, such as a building. Typically the second legs 78 of the inner fittings 26 of a pair of adjacent horizontally-aligned units 10 will be secured to a common supporting member 30—e.g., by a common bolt 80 including a cap nut at each end.

The securing or fixing means 28 comprises a bolt 86 and a nut 90 threaded thereon. One end 92 of bolt 86 is welded or otherwise secured to the inner surface of one end portion of the outer fitting 24, which is eventually disposed adjacent the outer pane 12, to form a one piece integral member. (A similar bolt 86 is also welded or otherwise secured to the same surface of the opposite end portion of the outer fitting 24, in vertical alignment with bolt 86, thus enabling opposite ends of the outer fitting 24 to be secured to two immediately adjacent vertically-aligned units 10.) The shank 94 of the bolt 86 intermediate the ends thereof may be threaded or unthreaded and passes through the full length of sleeve 50 with a slight radial clearance and then through an aperture 96 in the angle member first leg 76. The protruding end 98 of bolt 86 is threaded and receives the cap nut 90, which is preferably self-locking and only hand-tightened.

Preferably gaskets 100, such as an incompressible Aramid fiber gasket, are disposed intermediate the outer fitting 24 and outer pane 12 and intermediate the inner fitting first leg 76 and the inner pane 14 for protection of the panes 12, 14, respectively. Resilient washers (not shown) may be disposed intermediate the nut 90 and the inner fitting 26. Preferably the outer and inner patch fittings 24, 26, the bolt 86, and the cap nut 90 are each formed of rigid stainless steel, although other rust-proof materials of comparable structural quality may be employed instead.

It will be appreciated that the sleeve 50 centers the bolt 86 so that the bolt 86 does not contact the pane surfaces defining the pane apertures 20, thereby protecting the glass panes 12, 14 from what would otherwise be a deleterious contact with the metal bolt 86. As illustrated, the sleeve 50 need not extend all the way through either of the pane apertures 20 (although this is permissible), but need only extend sufficiently into the pane apertures 20 to achieve appropriate centering of the bolt 86 to provide protection of the panes 12, 14. This is, of course, also a function of the thickness of the annular wall of sleeve 50. The sleeve wall should be of sufficient thickness to insure that, even as the panes 12, 14 flex inwardly due to positive wind pressure or outwardly due to negative wind pressure, there is adequate clearance between the bolt 36 and the panes 12, 14 to prevent deleterious contact therebetween.

Figure 6:
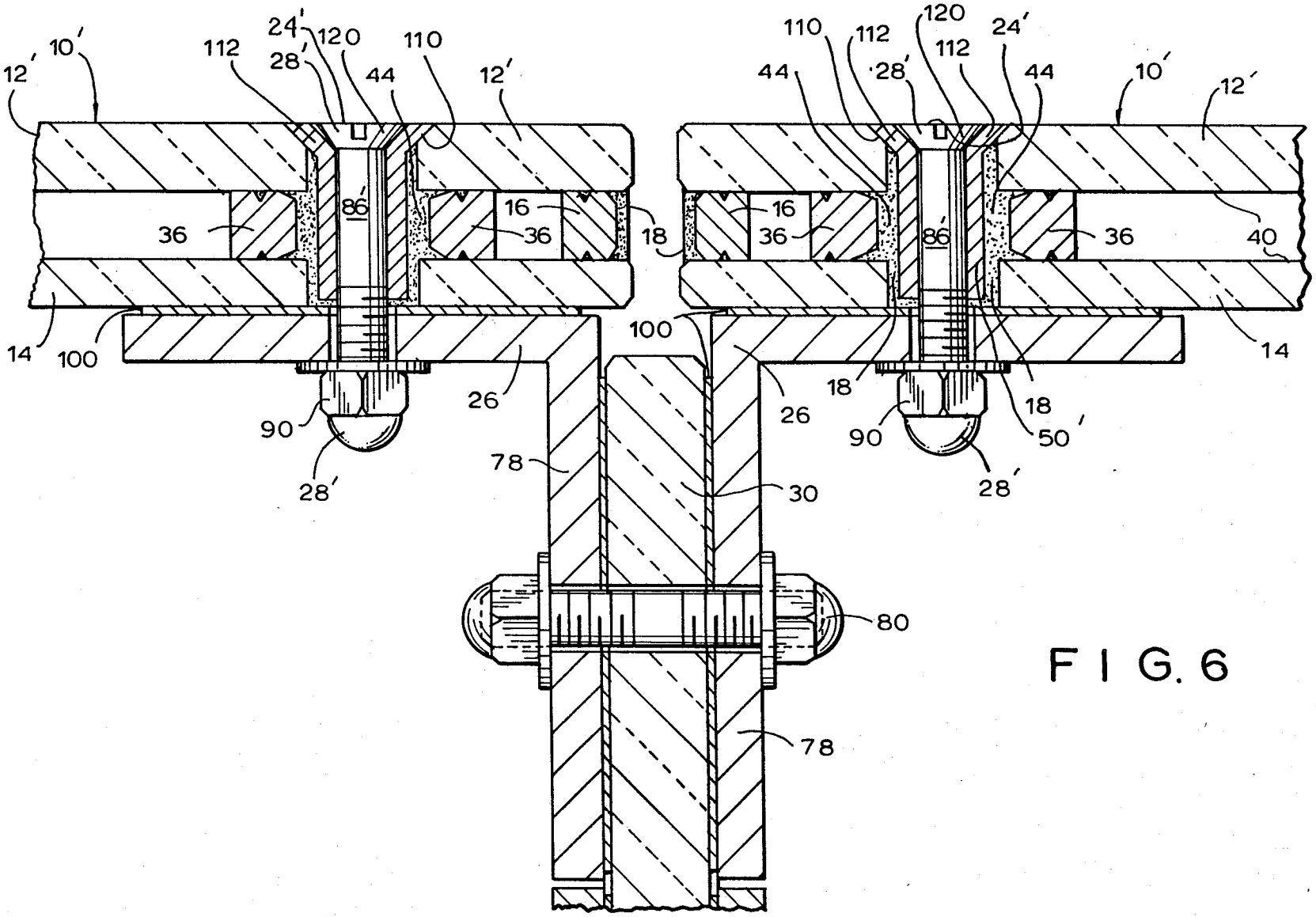
FIG. 6 is a view similar to FIG. 3, but illustrating an alternate embodiment of the present invention.

Referring now to FIG. 6, therein illustrated is an alternative embodiment of the present invention. In this embodiment, the unit 10' is identical to the unit 10 of the first embodiment except as noted herein. Elements which are structurally or functionally different than the correspondingly numbered elements of the first embodiment are signified by a primed numeral.

The outer surface of outer pane 12' is beveled outwardly to form a counterbore or countersink 110, and the outer fitting 24' comprises an outward flaring 112 of the outer end of the sleeve 50' configured and dimensioned to fit within the counterbore 110 of the outer pane 12' while limiting inward movement of the sleeve 50'. Obviously in this embodiment there is no bridging of adjacent units by the outer fitting 24 and, accordingly, each unit is independently supported by the attachment of the inner fitting 26 to the supporting member 30. Alternatively, the inner patch fitting 26 may be of sufficient length or height to span adjacent units 10' and receive one bolt 86' from each.

In this embodiment, the bolt 86' (part of fixing means 28') is separate and apart from the outer fitting 24' and may be provided with a flared head 120 fitting within the sleeve flaring 112 so that no part of the mounting means (e.g., fittings 24', 26 and fixing means 28') extends outwardly beyond the outer surface of the outer pane 12'. On the other hand, if desired, the bolt 86' may be provided with a head (not shown) which protrudes outwardly from the outer surface of the outer pane 12 for aesthetic reasons.

Figure 5A:
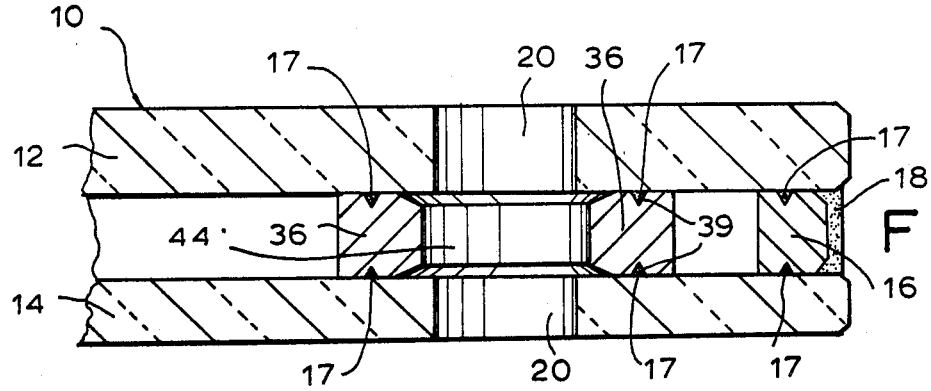
FIGS. 5A, 5B, 5C and 5D are fragmentary sectional views illustrating the unit in various stages of production.

Referring now to FIG. 5, and in particular to FIG. 5A thereof, assembly of the unit 10 is easy and rapid compared with the assembly of prior art units requiring mechanical fixing of the mounting means to one of the panes. Initially, the inner and outer panes 14, 12 are juxtaposed (with either pane being the top) with the spacing frame 16 and torus 36 appropriately positioned therebetween and with primary sealant 17 in the circumferential grooves 39 of the torus 36 and spacing frame 16. At this point or at a later point, secondary sealant 18 is added to the peripheral surface of the spacing frame 16 between the panes 12, 14 in order to complete the peripheral seal about the spacing frame 16.

Figure 5B:
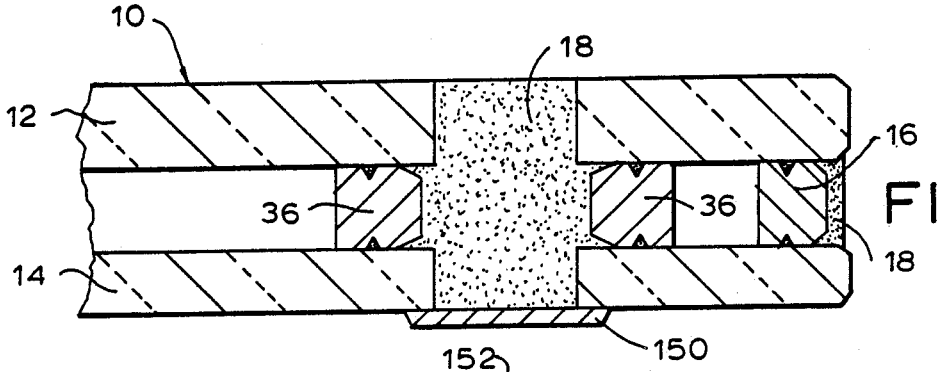

Referring now to FIG. 5B, pane aperture 20 of the bottom pane (here illustrated as inner pane 14) is then covered with a blocking member 150. Secondary sealant 18 is next injected through the pane aperture 20 of the upper pane (here illustrated as outer pane 12) so that it completely fills both pane apertures 20 and the torus hollow 44 therebetween. The blocking member 150 prevents escape of the injected secondary sealant 18 through the lower pane aperture 20.

Figure 5C:
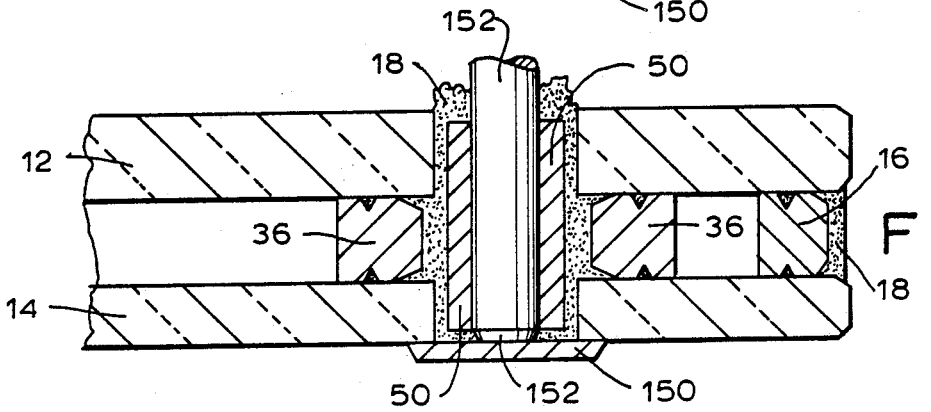

Referring now to FIG. 5C, a temporary subassembly, comprised of the sleeve 50 and a dowel 152 removably but snugly occupying the central hollow thereof and extending slightly beyond both sleeve ends, is inserted through the upper pane aperture 20 and the hollow 44 and into the bottom pane aperture 20 until the bottom end of dowel 152 contacts the blocking member 150. The contacting end of dowel 152 extends slightly beyond the bottom end of sleeve 150 about 0.16 cm (0.06 inch) as appropriate to properly position sleeve 50 relative to the pane apertures 20. (As earlier noted, the sleeve 50 may extend totally through the pane apertures 20 or terminate partially therethrough.) Insertion of the subassembly 50/152 applies pressure to the secondary sealant 18. Thus the secondary sealant 18 enters the small gaps between the converging end surface of the torus 36 (adjacent hollow 44) and the facing pane surfaces 40, and the excess sealant 18 is forced out through the lateral gap between the outer surface of sleeve 50 and the inner surface of the upper pane defining aperture 20.

Figure 5D:
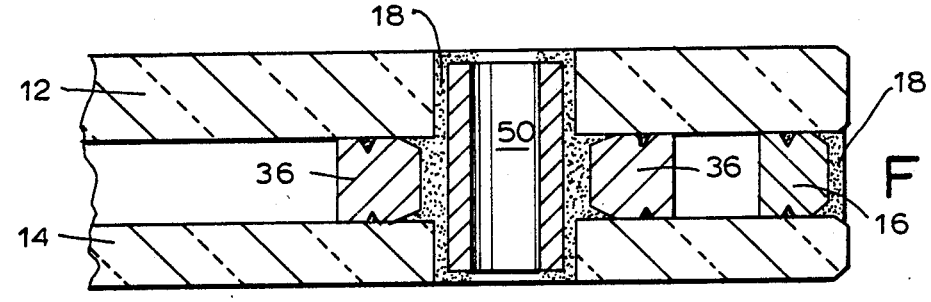

Referring now to FIG. 5D, after partial setting of the secondary sealant 18 in about 3–5 minutes, the blocking member 150 is removed, the dowel 152 is removed from sleeve 50 (the sleeve 50 being held in place by the partially cured sealant 18), and the excess secondary sealant 18 extending upwardly beyond the upper surface of the upper pane is removed. This leaves the sleeve 50 appropriately positioned and secured to the inner and outer panes 14, 12 and torus 36, with the passageway defined by sleeve 50 extending through the unit 10, ready for receipt of the fixing member 86. If desired, the blocking member 150 and dowel 152 may be left in place until the unit 10 arrives at the assembly site, at which time the sealant 18 is fully cured (about 24 hours).

This procedure poses no danger of breakage of either pane 12, 14 and permits the unit 10 to be shipped almost immediately to the assembly site. The secondary sealant 18 partially sets, sufficiently for handling, in a few minutes, with the further cure occurring during transit to the assembly site so that the unit 10 arrives at the assembly site at full strength, ready for use.

Assembly of the unit 10' of the second embodiment is similar to assembly of the unit 10 of the first embodiment in almost all respects but one. As the outward flare 112 of the sleeve 50' contacts the bevel 110 of the outer pane 10', clearly there is no space intermediate the sleeve 50' and outer pane 12' through which excess secondary sealant 18 can escape from the hollow 44. Accordingly, the inner pane 14 is initially the bottom pane and it is the bottom or inner pane aperture 20 which is blocked. After the secondary sealant 18 is introduced into the hollow 44 through the top or outer pane aperture 20, it is allowed to set slightly (about one or two minutes) until it is self-supporting. Then the blocking member 50 is removed from the bottom or inner pane 14. Thus, as the sleeve/dowel temporary subassembly 50'/152 is inserted into the torus hollow 44, excess secondary sealant 18 is forced out of the unit through the bottom or inner pane aperture 20.

To summarize, the present invention provides an improved sealed doubled glazing unit which does not have a fixing assembly mechanically attached to either pane, the unit affording improved air-tight isolation of the fixing assembly from the remainder of the unit. The unit has a simplified and more economical construction in which the fixing assembly is secured in place without being mechanically attached to either pane. The present invention further provides a simple, fast and economical method of manufacturing the unit.

Now that the preferred embodiments of the present invention have been shown and described in detail, various modifications and improvements thereon will become readily apparent to those skilled in the art. Accordingly, the present invention is to be construed broadly and in a manner consistent with the spirit and scope of the invention herein.

I claim:

1. A sealed double glazing unit comprising:

(A) an outer pane and an inner pane, each defining in at least one corner thereof an aperture therethrough, said pane apertures being axially aligned;

(B) peripheral sealing means about the periphery of said panes; and (C) means, disposed in said at least one corner of said panes, for enabling mounting of said unit to a supporting member, including (i) a torus having opposed end surfaces and a sidewall connecting said end surfaces and defining a hole, said torus extending between said panes coaxially with said pane apertures and having the end surfaces of said torus secured to facing surfaces of said panes about said pane apertures, (ii) a sleeve extending through said hole of said torus and having its end portion disposed at least partially within respective ones of said pane apertures, and (iii) sealant securing the outer surface of said sleeve to the inner surface of said torus.

2. A sealed double glazing unit comprising:

(A) an outer pane and an inner pane, each defining in at least one corner thereof an aperture therethrough, said pane apertures being axially aligned;

(B) peripheral sealing means about the periphery of said panes; and (C) means, disposed in said at least one corner of said panes, for enabling mounting of said unit to a supporting member, including (i) a torus having opposed end surfaces and a sidewall connecting said end surfaces and defining a hole, said torus extending between said panes coaxially with said pane apertures and having the end surfaces of said torus secured to facing surfaces of said panes about said pane apertures, (ii) a sleeve extending through said hole of said torus and having its end portion disposed at least partially within respective ones of said pane apertures, and (iii) sealant securing the outer surface of said sleeve to the inner surface of said torus, and sealant disposed intermediate said sleeve outer surface and the facing surfaces of said torus and said pane apertures, whereby substantially the entire outer surface of said sleeve is secured to said torus and said panes by said sealant.

3. The unit of claim 1 wherein neither of said panes is mechanically clamped to said sleeve or said torus.

4. The unit of claim 3 wherein said torus has generally planar end surfaces which converge slightly adjacent the hole thereof, thereby to provide space for said sealant intermediate said torus and said panes.

5. The unit of claim 3 wherein one of said pane apertures has an inner diameter and said sleeve has an outer diameter appreciably less than the inside diameter of said one of said pane apertures.

6. The unit of claim 3 wherein said sleeve is nylon.

7. The unit of claim 3 wherein said sealant is slightly flexible.

8. The unit of claim 3 wherein said sealant forms an air-tight connection between said sleeve outer surface and said torus and panes.

9. A sealed double glazing unit comprising:

(A) an outer pane and an inner pane, each defining in at least one corner thereof an aperture therethrough, said pane apertures being axially aligned;

(B) peripheral sealing means about the periphery of said panes; and (C) means, disposed in said at least one corner of said panes, for enabling mounting of said unit to a supporting member, including (i) a torus having opposed end surfaces and a sidewall connecting said end surfaces and defining a hole, said torus extending between said panes coaxially with said pane apertures and having the end surfaces of said torus secured to facing surfaces of said panes about said pane apertures, (ii) a sleeve extending through said hole of said torus and having its end portions disposed at least partially within respective ones of said pane apertures, (iii) sealant securing the outer surface of said sleeve to the inner surface of said torus, (iv) an outer patch fitting and an inner patch fitting; and (v) securing means extending through said sleeve and connecting said inner and outer fittings for locking said outer fitting, said panes, said torus, said sleeve and said inner fitting together as a unit, said fittings enabling joinder of said unit with another vertically-aligned unit and another horizontally-aligned unit.

10. The unit of claim 9 wherein said supporting member is an adjacent one of said units.

11. The unit of claim 10 wherein said mounting means mounts said unit to at least one of said other units via an intermediate member comprising a structural element or mullion.

12. The unit of claim 9 wherein said sleeve is configured and dimensioned to receive and isolate from said panes, a threaded bolt passing through said fittings, as part of said securing means.

13. The unit of claim 12 wherein said securing means comprises a bolt of integral one-piece construction with said outer fitting.

14. The unit of claim 12 wherein said inner fitting extends vertically to enable direct joinder with a vertically-aligned one of said units and rearwardly to enable indirect joinder with a horizontally-aligned one of said units through an intermediate member comprising a mullion or structural element.

15. The unit of claim 9 wherein said outer fitting is disposed totally outside of said pane aperture of said outer pane.

16. The unit of claim 9 wherein said outer fitting and sleeve are of integral one-piece construction, said outer fitting being disposed totally within said pane aperture of said outer pane, and said securing means including a bolt having a head disposed totally within said outer fitting.

17. A sealed double glazing unit comprising:

(A) an outer pane and an inner pane, each defining in at least one corner thereof an aperture therethrough, said pane apertures being aligned;

(B) peripheral sealing means about the periphery of said panes spacing said panes apart; and (C) means, disposed in said at least one corner of said panes, for enabling mounting of said unit to other units, including (i) a torus having opposed end surfaces and a sidewall connecting said end surfaces and defining a hole, said torus extending between said panes coaxially with said pane apertures and having the end surfaces of said torus secured to facing surfaces of said panes about said pane apertures, (ii) a nylon sleeve fitting loosely within and extending through the hole of said torus and having its end portions disposed loosely within said pane apertures, and (iii) a slightly flexible sealant forming an air-tight connection between and securing substantially the entire outer surface of said sleeve and said torus and said panes.

18. The unit of claim 17 wherein said mounting means additionally includes (iii) an outer patch fitting and an inner patch fitting; and (iv) securing means extending through said sleeve connecting said inner and outer fittings for locking said outer fitting, said panes, said torus, said sleeve and said inner fitting together as a unit, the inner surface of said sleeve being configured and dimensioned to receive a threaded bolt as part of said securing means.

19. A method of making a sealed double glazing unit comprising the steps of:

(A) providing an outer pane and an inner pane, each defining in at least one corner thereof an aperture therethrough;

(B) superposing the panes in spaced apart relationship with the pane apertures axially aligned and positioning and securing a torus defining a hole between the panes coaxially with each pane aperture with the end surfaces of the torus facing said panes to form an air-tight connection between the torus end surfaces and the facing pane surfaces;

(C) substantially filling the volume of the hole of the torus with sealant;

(D) for each at least one corner providing a sleeve having a removable dowel fully occupying the interior of the sleeve and inserting the dowel-containing sleeve through one aperture of one of the panes, through the hole of the torus, and into the axially aligned aperture of the other of the panes before the sealant is cured;

(E) removing the dowel from the sleeve to leave sealant disposed intermediate the sleeve outer surface and the torus inner surface, thereby securing the sleeve and the torus, while leaving the sleeve interior open for passage of a bolt therethrough; and (F) curing the sealant.

20. The method of claim 19 including in step (C) filling the volumes of both pane apertures with sealant, thereby securing by sealant the sleeve outer surface to both the torus and the pane apertures.

21. The method of claim 20 including prior to step (C) blocking the exterior surface of the other pane aperture to prevent escape of sealant therethrough, in step (D) driving excess sealant out of the unit through the one pane aperture by inserting the dowel-containing sleeve, and thereafter unblocking the exterior surface of the other pane.

22. The method of claim 19 including in step (C) filling the volume of at least one of the pane apertures with sealant, thereby securing by sealant the sleeve outer surface to both the torus and at least one of the pane apertures.

23. The method of claim 22 including prior to step (C) blocking the exterior surface of the other pane aperture to prevent escape of sealant therethrough, intermediate steps (C) an (D) allowing partial cure of the sealant and then unblocking the exterior surface of the other pane aperture, and in step (D) driving excess sealant out of the unit through the other pane aperture by inserting the dowel-containing sleeve through the one pane aperture.

* * * * *